US006638096B1

(12) United States Patent
Jones et al.

(10) Patent No.: US 6,638,096 B1
(45) Date of Patent: Oct. 28, 2003

(54) ELECTRICAL CONNECTOR HAVING IMPROVED LATCHING MECHANISM

(75) Inventors: Dennis B. Jones, Orange, CA (US); David Tso-Chin Ko, Fullerton, CA (US); George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/227,043

(22) Filed: Aug. 23, 2002

(51) Int. Cl.[7] ..... H01R 13/62

(52) U.S. Cl. ..... 439/352

(58) Field of Search ..... 439/488, 489, 439/350–358

(56) References Cited

U.S. PATENT DOCUMENTS 4,986,766 A 1/1991 Leonard et al.
6,325,656 B1 * 12/2001 Fakuda et al. ..... 439/358
6,383,011 B2 * 5/2002 Chen ..... 439/358

* cited by examiner

*Primary Examiner*—Lynn Feild
*Assistant Examiner*—J. F. Duverne
(74) *Attorney, Agent, or Firm*—Wei Te Chung

(57) ABSTRACT

An electrical connector (1) comprises an insulative housing (12), a latch member (20) and an actuator member (30) integrally formed on a top face (15) of the housing. The housing defines a plurality of cavities (14) for receiving a plurality of terminals therein. The latch member has a deflectable portion in spaced relationship to the top face for latching and detaching a complementary connector. The actuator member is located above the latch member. The actuator member has a pair of arced ribs (32) extending from the top face, an anti-overstress bar (34) connected between the arced ribs for limiting deflection of the deflectable portion of the latch member relative to the top face of the insulative housing, and a handle (36) extending from the anti-overstress bar. When the handle is depressed, the anti-overstress bar depresses the deflectable portion of the latch member to cause the deflectable portion to move downwardly, whereby an engagement between the deflectable portion and a complementary connector is released.

12 Claims, 10 Drawing Sheets

ELECTRICAL CONNECTOR HAVING IMPROVED LATCHING MECHANISM

BACKGROUND OF THE INVENTION

1. Field of the Invention

The present invention relates to an electrical connector, and particularly to an electrical connector having a latch member and an actuator member cooperated with each other for latching/detaching with/from a complementary connector.

2. Description of Prior Art

Many electrical connectors include latch means for securely but releasably retaining a pair of electrical connector housings in a mated condition. More particularly, theses prior art connectors include mateable pairs of molded plastic housings, each of which is constructed to receive a plurality of terminals therein. The terminals of one housing electrically contact the terminals of the other housing when the housings are in their mated condition.

Many electrical connectors are used in environments where they will be repeatedly connected and disconnected by personnel having relatively little familiarity with the mechanics and intended used of the connector. For example, electrical connectors often are employed in photostatic copiers and other office equipment that may periodically be serviced by field technicians or by the office staff that uses the copier other such business machine. Field technicians often are not adequately trained on the proper usage of every electrical connector they are likely to encounter. Office personnel using various business machines typically have even less training and familiarity with the electrical connectors they may periodically be required to connect and/or disconnect. This lack of familiarity with the electrical connectors manipulated by field or office personnel can result in overstressing the latch mechanisms employed to lockingly but releasably retain electrical connector housings in a mated condition. For example, inexperienced field personnel may unintentionally bias a latch mechanism too far, thereby breaking or reducing the effectiveness of the latch.

Electrical connector housings have been developed to minimize this potential for overstressing the latch structures thereof. For example, U.S. Pat. No. 4,462,654 which issued to Aiello on Jul. 31, 1984 shows a latch integrally and pivotally connected to a housing, the forward end of the latch extends from the pivoted connection to define a latch portion which is engageable with corresponding structure on a mateable housing. The forward end of the latch member extends in the opposite direction from the pivot and includes an overstress stop which is pivotable into a lug or wall on the electrical connector housing. Contact between the overstress stop and the lug or wall of the electrical connector housing is intended to limit the amount of rotation around the pivot point during the normal engagement of the electrical connector housings. Although this construction may control the amount of pivoting during proper use of the electrical connector, it provides no positive anti-stress protection adjacent the forward end of the latch member. Thus, field personnel inexperienced with the intended operation of the latch shown in U.S. Pat. No. 4,462,654 could apply rotatable pressure to the forward most end of the latches for either locking or releasing the electrical connector housings to one another. Such rotational forces exerted on the forward end of the latch, thereby causing the latch to break or be of reduced effectiveness.

Another problem that can be encountered when inexperienced field personnel skilled in this art as "fish-hooking".

In particular, the latch members on many electrical connectors are cantilevered structures that effectively function as fishhooks which may catch insulated leads as the electrical connector is being inserted into or removed from an electrical apparatus. Fishhooking can damage an adjacent circuit that is unintentionally caught by the latch structure of the electrical housing. Additionally, an attempt to operate the latch structure while a wire or other lead is in its fishhooked engagement can permanently damage the latch.

Hence, an improved electrical connector meeting the above-mentioned demands is desired.

BRIEF SUMMARY OF THE INVENTION

A first object of the present invention is to provide an electrical connector having a latch member which is prevented from being entangled with conductive wires of an inserted cable.

A second object of the present invention is to provide an electrical connector having an actuator member constructed to positively prevent overstress of the latch member thereof.

To fulfill the above-mentioned objects, an electrical connector in accordance with the present invention comprises an insulative housing, a latch member and an actuator member integrally formed on a top face of the housing. The housing defines a plurality of cavities extending through opposite front and rear faces thereof for receiving a plurality of terminals therein. The latch member has a deflectable portion in a spaced relationship to the top face for latching and detaching a complementary connector. The actuator member is adjacent but separate from the latch member. The actuator member has a pair of arced ribs extending from the top face, an anti-overstress bar connected between the pair of arced ribs for limiting deflection of the deflectable portion of the latch member relative to the top face of the insulative housing, and a handle extending from the anti-overstress bar. When the handle is depressed, the anti-overstress bar depresses the deflectable portion of the latch member to cause the deflectable portion to move downwardly, whereby an engagement between the deflectable portion and a complementary connector is released.

Other objects, advantages and novel features of the invention will become more apparent from the following detailed description of the present embodiment when taken in conjunction with the accompanying drawings.

DETAILED DESCRIPTION OF THE INVENTION

Figure 1:
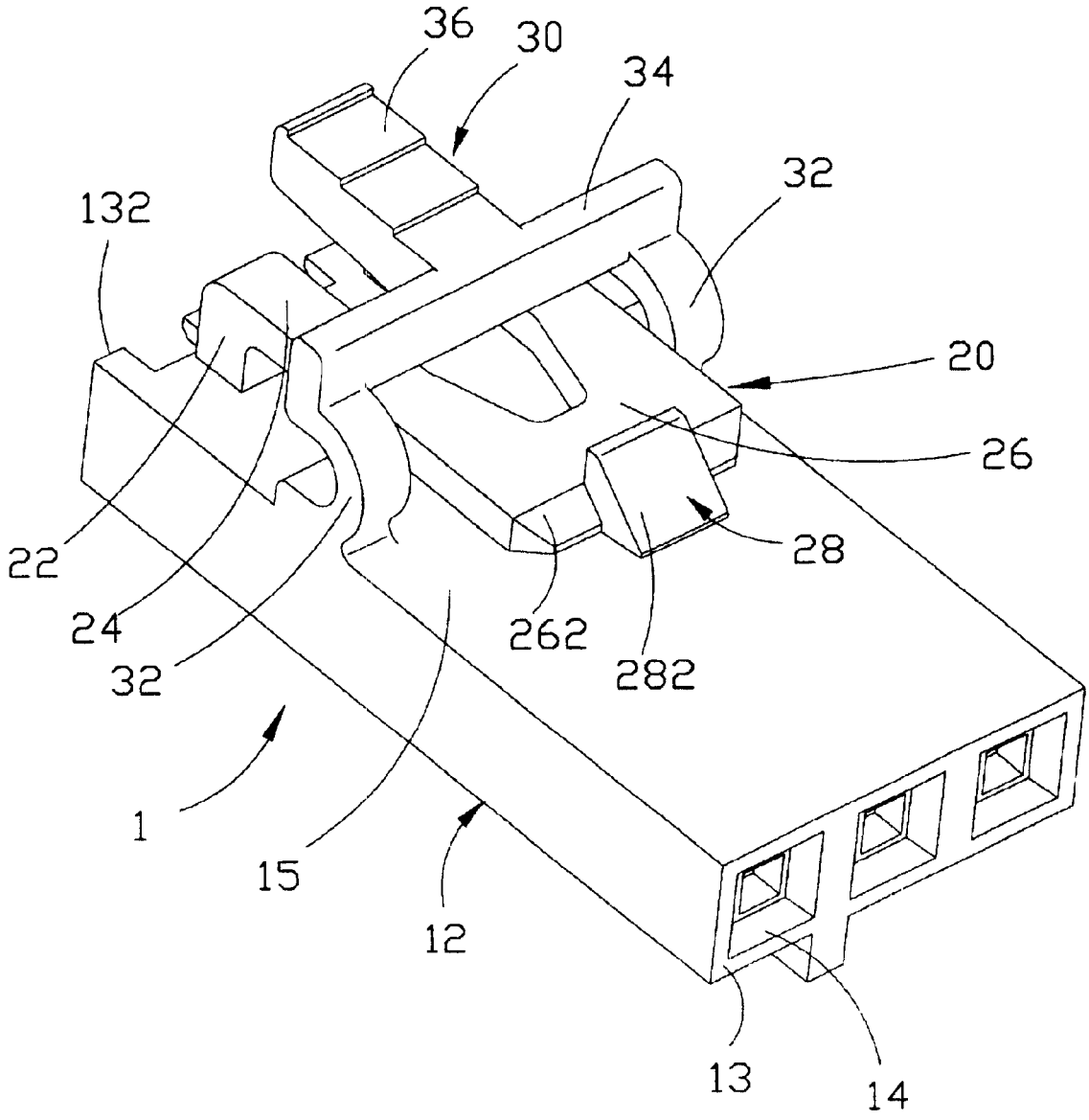
FIG. 1 is a first perspective view of an electrical connector in accordance with the present invention.
Figure 2:
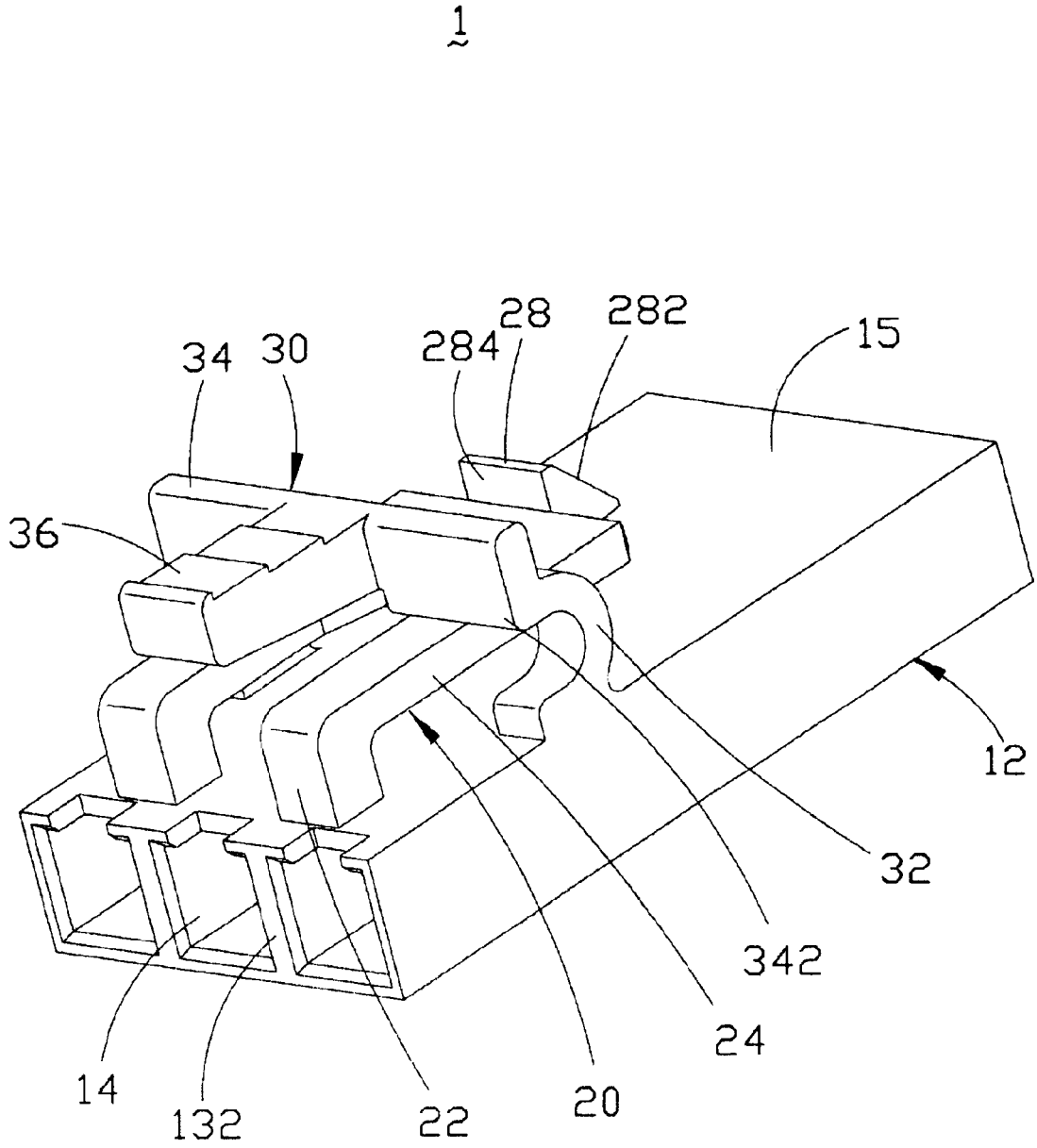
FIG. 2 is a second perspective view of the electrical connector in accordance with the present invention.
Figure 3:
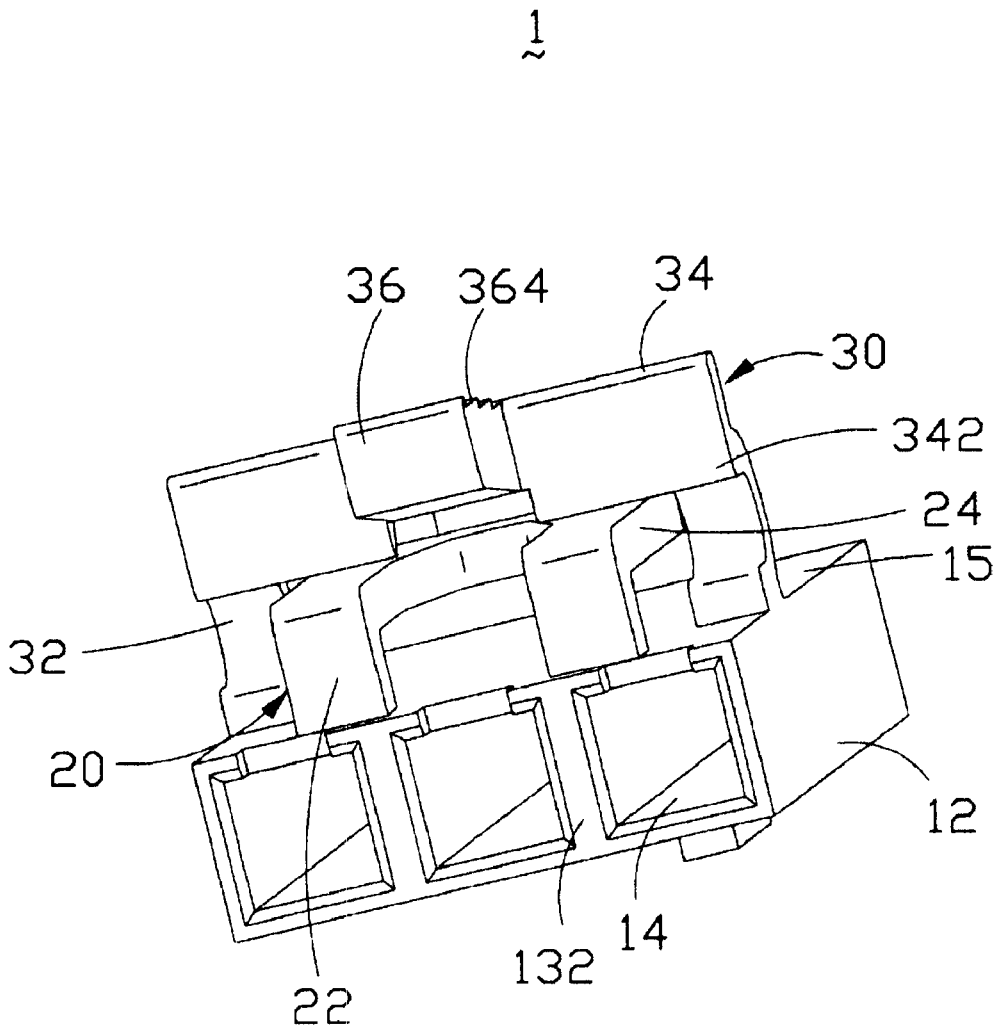
FIG. 3 is a third perspective view of the electrical connector in accordance with the present invention.
Figure 4:
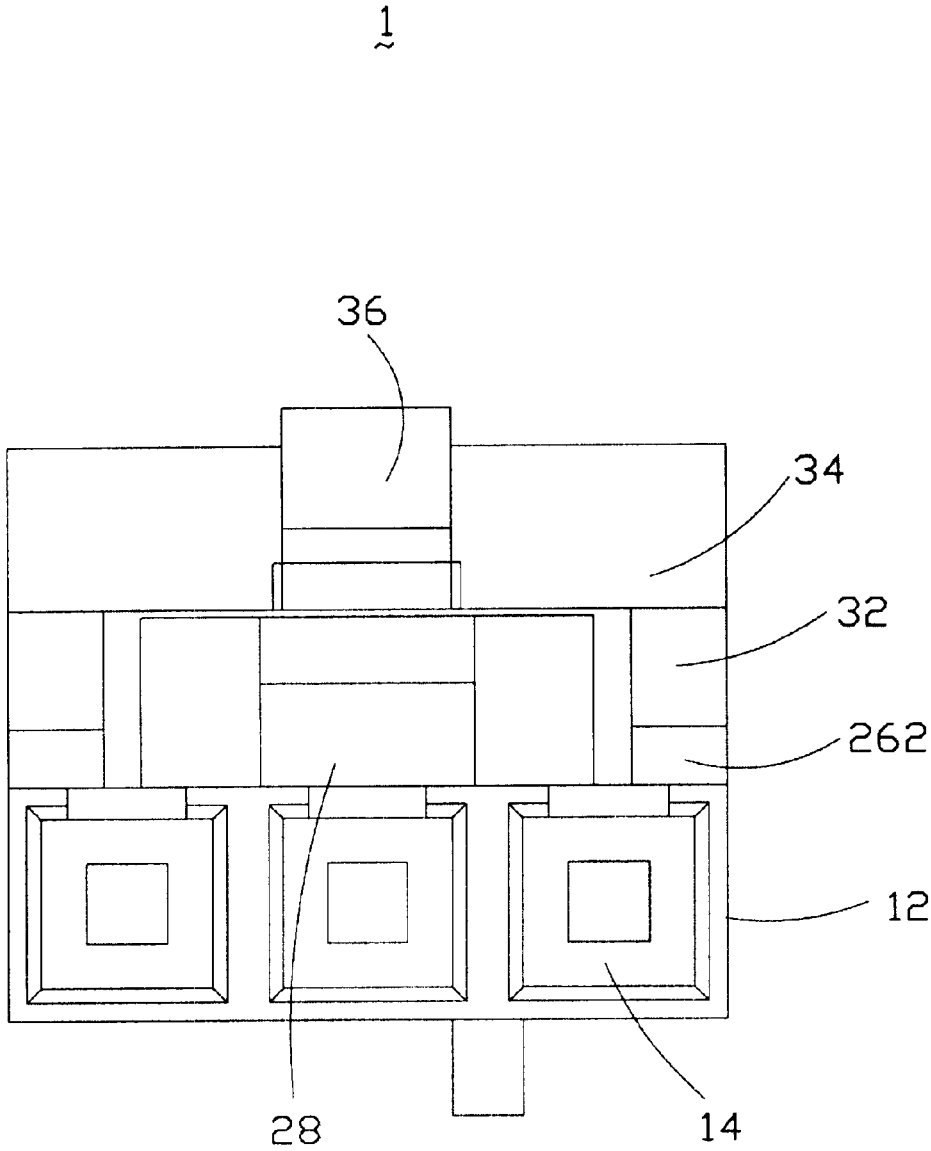
FIG. 4 is a front view of FIG. 3.
Figure 5:
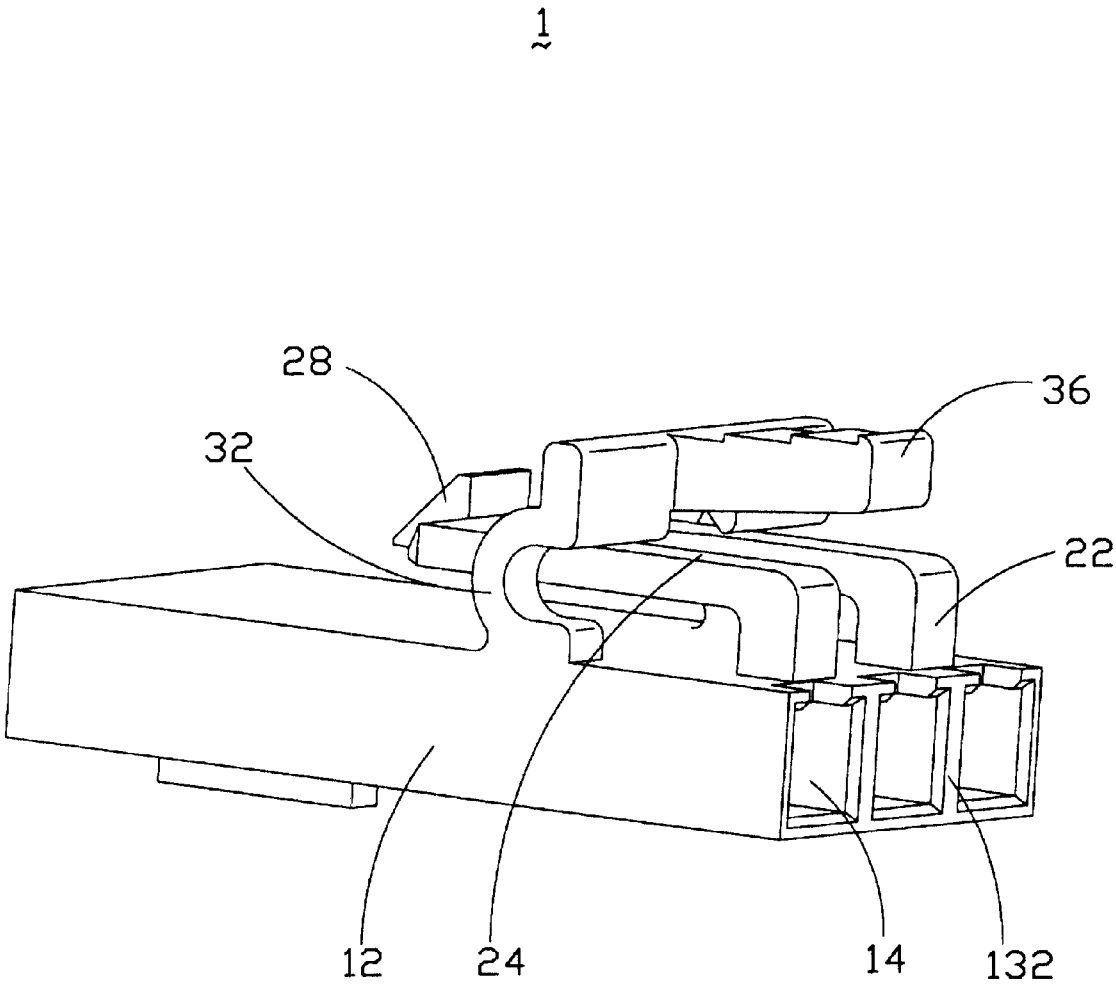
FIG. 5 is a fourth perspective view of the electrical connector in accordance with the present invention.
Figure 6:
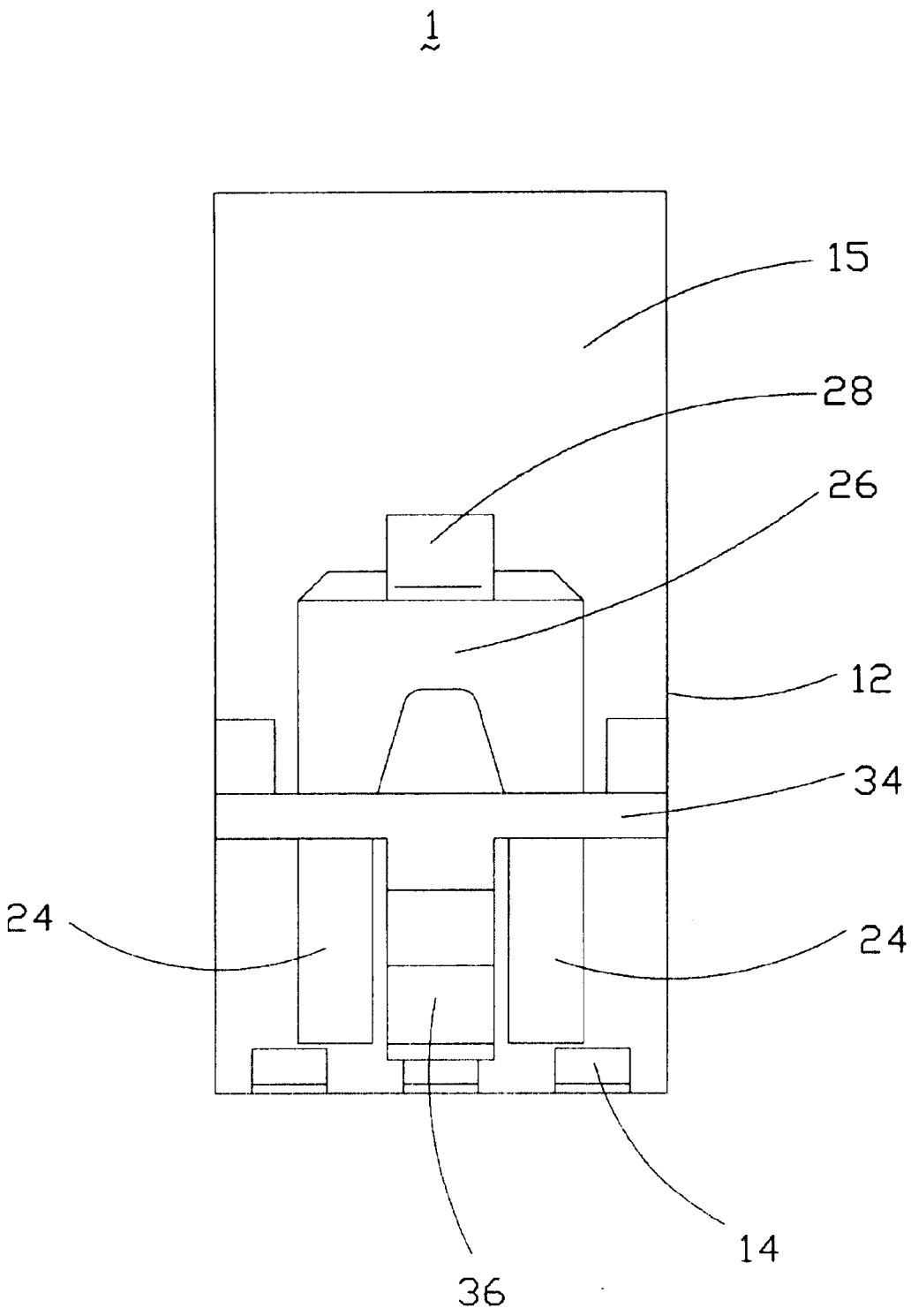
FIG. 6 is a top view of FIG. 5.

An electrical connector in accordance with the present invention is identified generally by reference number 1 in FIG. 1. The electrical connector 1 comprises a unitarily molded plastic housing 12 defining three cavities 14 longitudinally extending through opposite front and rear faces 13, 132 thereof for receiving a corresponding number of terminals (not shown) therein. The electrical connector 1 is a male connector which is mateable with a female connector indicated generally by reference number 4 in FIG. 8. The female connector 4 comprises a dielectric body 42 and a plurality of conductive contacts (not shown) received in the dielectric body 42 for mating with corresponding terminals of the electrical connector 1. The dielectric body 42 further forms a cross-beam 46 above the top wall 45 near a mating face 48 of the female connector and defines a locking aperture 44 in a top wall 45 thereof.

Further referring to FIGS. 2 to 7, a latch member 20 and an actuator member 30 are unitarily molded with the housing 12 and formed on a top face 15 of the housing 12, generally adjacent to the rear face 132 of the housing 12. The actuator member 30 is located above the latch member 20.

Figure 8:
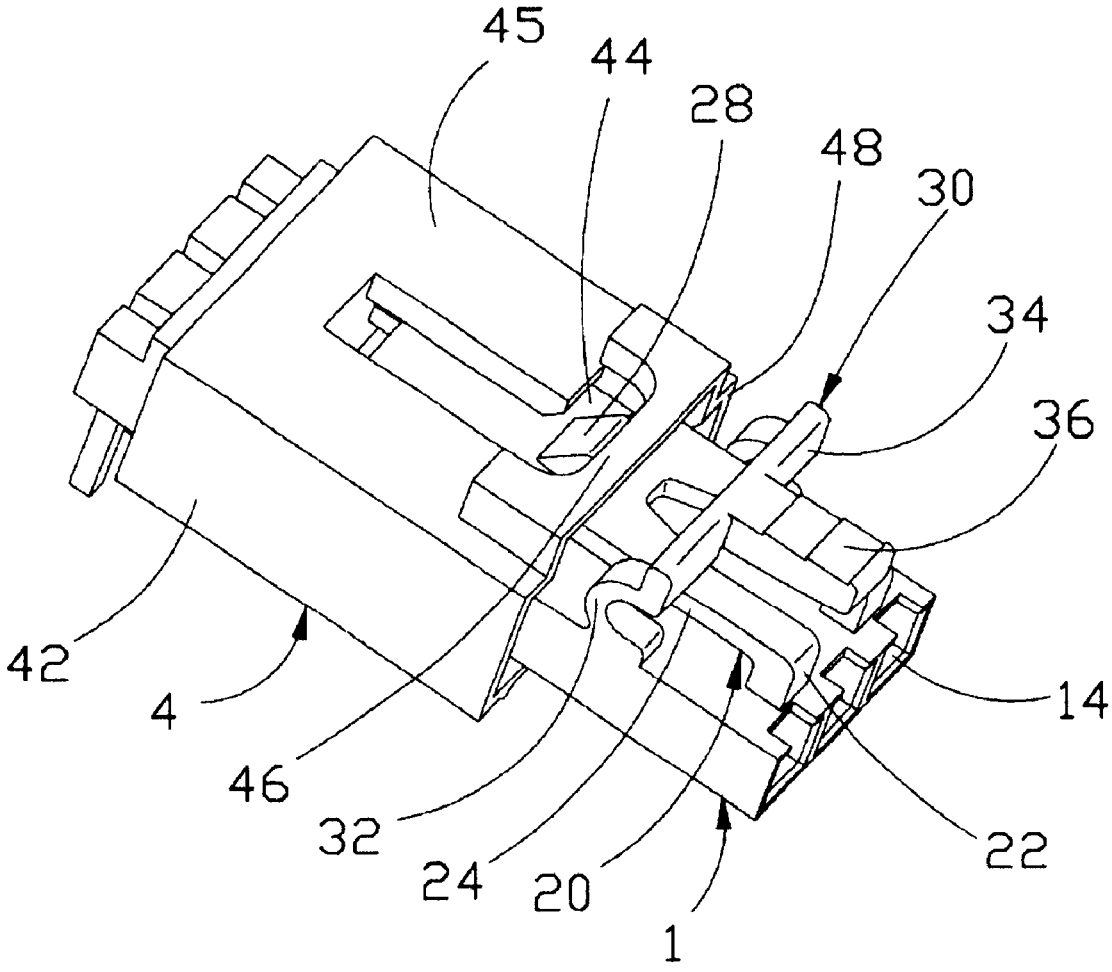
FIG. 8 is a perspective view of the electrical connector in accordance with the present invention engaged with a complementary connector.

The latch member 20 is substantively in a "U" shape and has a pair of base portions 22 vertically extending from the top face 15 and a pair of cantilevered beams 24 horizontally extending forwardly from the base portions 22, respectively. The base portion 22 have a predetermined height to prevent conductive wires of a neighboring connector (not shown) from entering a space below a handle 36 of the actuator member 30 to hinder the operation of the actuator member 30 and accordingly the latch member 20. The conductive wires (not shown) are used to extend through the cavities 14 in the rear face 132 of the housing 12 to electrically connect the terminals of the electrical connector 1 with an electrical device, such as a power supply in a computer. The cantilevered beams 24 are in a spaced relationship and substantively parallel to the top face 15 of the housing 12. A cross bar 26 is integrally connected between the cantilevered beams 24. Additionally, the latch member 20 forms a locking protrusion 28 on a front side 262 of the cross bar 26. The locking protrusion 28 comprises a ramped forward surface 282 and a rearward locking surface 284 which is generally perpendicular to the top face 15 of the housing 12. The rearward locking surface 284 is positioned along the connector 1 at a location to enter the locking aperture 44 and engage the cross-beam 46 of the female connector 4 when the electrical connector 1 mates with the female connector 4, as shown in FIG. 8. More particularly, the meteable housing 12 and the dielectric body 42 are dimensioned such that the ramped forward surface 282 of the locking protrusion 28 will cammingly engage cross-beam 46 of the dielectric body 42 during the forwardly insertion of the electrical connector 1 into the female connector 4. The camming engagement of the forward ramped surface 282 with the cross-beam **4*i*6 on the dielectric body 42 will cause the latch member 20 to deflect toward the top face 15, and thereby permit continued insertion of the electrical connector 1 into the female connector 4. However, upon a sufficient insertion, the locking protrusion 28 will locate in front of the cross-beam 46 to permit the latch member 20 to resiliently return to its unbiased condition in the locking aperture 44. Thus, the rearward locking surface 282 of the locking protrusion 28 will engage the cross-beam 46 of the dielectric body 42 to lockingly but releaseably hold the male and female connectors 1, 4 together in their mated condition, as shown in FIG. 8**.

Figure 7:
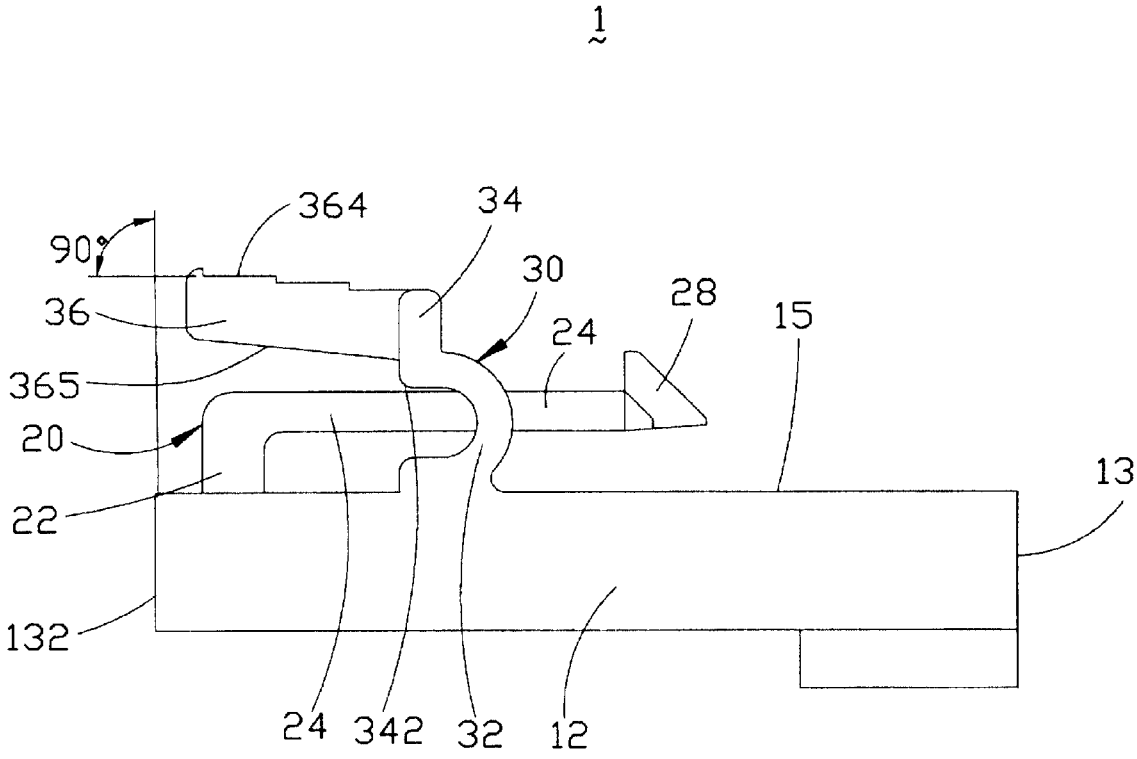
FIG. 7 is a side view of FIG. 5.

The actuator member 30 forms a pair of arced ribs 32 integrally projecting from opposite side edges of the housing 12, an anti-overstress bar 34 connected between top ends of the arced ribs 32, and a handle 36 horizontally extending rearwardly from a middle portion of the anti-overstress bar 34. The arced ribs 32 are located outside the cantilevered beams 24. As best seen in FIG. 7, the anti-overstress bar 34 is located above the cantilevered beams 24 of the latch member 20 a distance. Thus, the anti-overstress bar 34 does not contact with the latch member 20 in its normal position. The anti-overstress bar 34 forms a contact portion 342 at its lower and rear end for pressing against the cantilevered beams 24 of the latch member 20 when unlatching the lock between the locking protrusion 28 and the cross-beam 46 to inmate the female connector 4 from the male connector 1. In particular, any attempt by a technician to urge the latch member 20 away from the top face 15 of the housing 12 will be positively limited by an engagement of the contact portion 342 of the anti-overstress bar 34 with the cantilevered beams 24 of the latch member 20. A top surface 364 of the handle 36 is in a shape of a terrace and substantially forms a right angle with respect to the rear face 132 of the housing 12. The handle 36 has a slanted bottom face 365 extending upwardly and rewardly from the anti-overstress bar 34 toward the rear face 132 of the housing 12. A V-shaped space is defined between the bottom face 365 of the handle 36 and the cantilevered beams 24. The contact portion 342 depresses the cantilevered beams 24 a distance large enough to cause the locking protrusion 28 to totally escape from the cross-beam 46 of the female connector 4.

Figure 9:
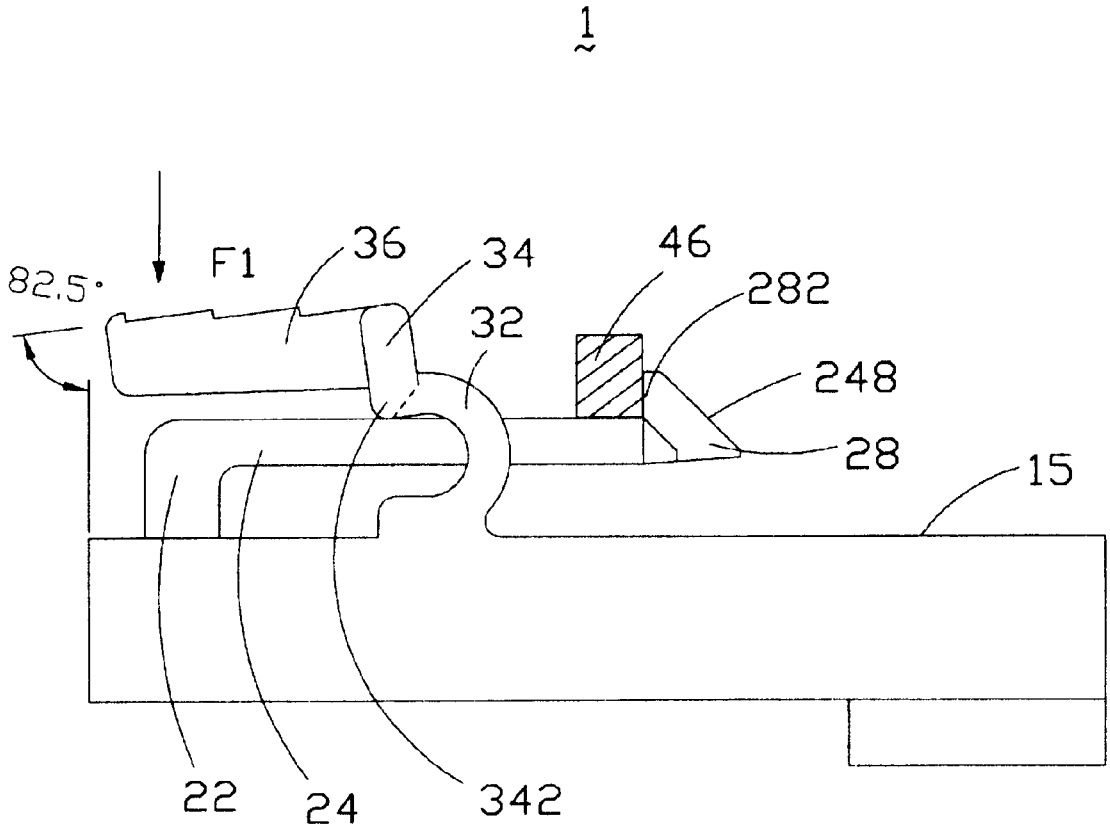
FIG. 9 is a side view showing that a latch member of the electrical connector in accordance with the present invention is to be activated to disengage from a cross-beam of the complementary connector.
Figure 10:
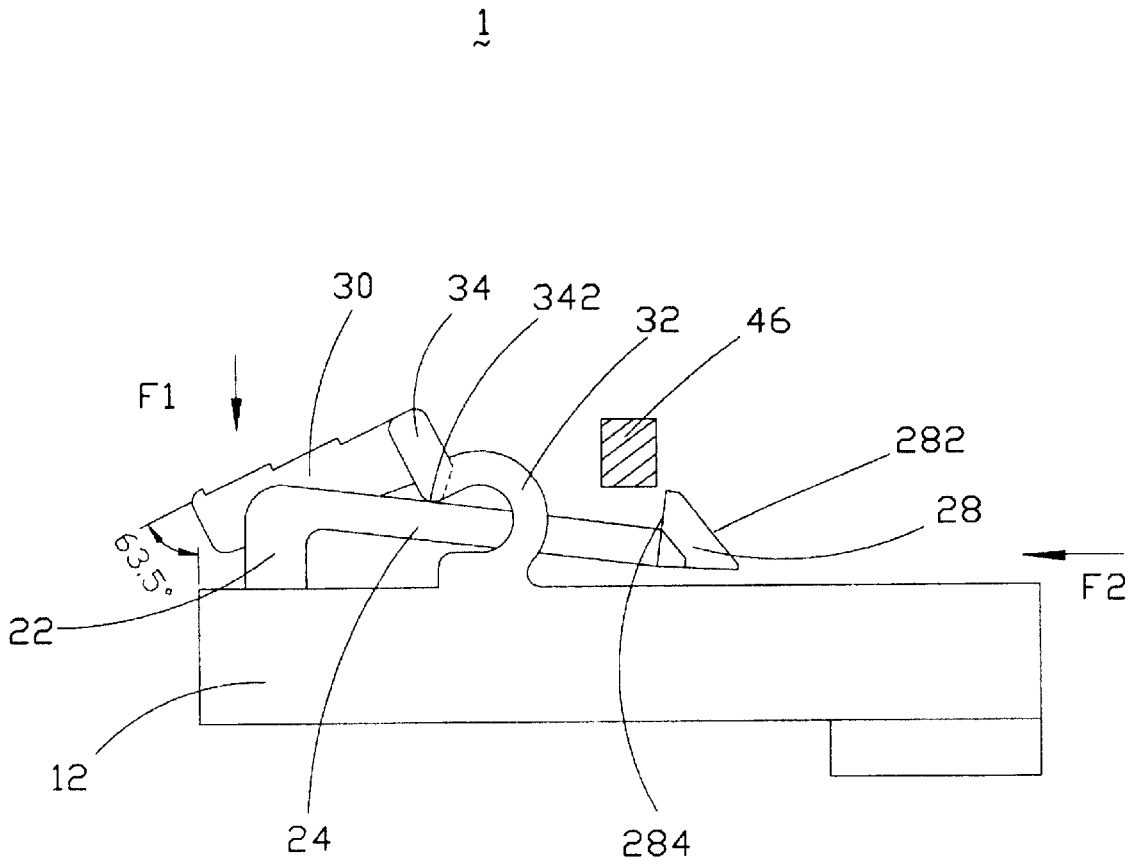
FIG. 10 is a view similar to FIG. 9 wherein the latch member of the electrical connector is activated to entirely disengage from the cross-beam of the complementary connector.

Further referring to FIGS. 9 and 10, two steps for disengaging the female connector 4 from the male connector 1 are shown. In the first step, a downward pressing force F1 is applied onto the handle 36 of the actuator member 30 and the top surface 364 of the handle 36 forms an angle of about 82.5 degrees with respect the rear face 132 of the housing 12 at this point. The contact portion 342 of the anti-overstress bar 34 thus presses the cantilevered beams 24 of the latch member 20 downward by the pressing force F1. The locking protrusion 28 begins to move downward away from the cross-beam 46 of the female connector 4. When the top surface 364 of the handle 36 is moved downwardly by the force F1 to form an angle of about 63.5 degrees with respect to the rear face 132 of the housing 12, a horizontal rearward force F2 can be applied to the male connector 1 to pull it away from the female connector 4. Thus, the male connector 1 is effectively and securely disengaged from the female connector 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of cavities for receiving a plurality of terminals therein and forming a top face;

a latch member formed on the top face and having a deflectable portion in a spaced relationship to the top face for latching and detaching a complementary connector; and an actuator member formed on the top face and being separate from the latch member, the actuator member having a pair of arced ribs extending from the top face, an anti-overstress bar connected between the pair of arced ribs for limiting deflection of the deflectable portion of the latch member relative to the top face of the insulative housing, and a handle extending from the anti-overstress bar for receiving an operation force to the actuator member; wherein the plurality of cavities extend through opposite front and rear faces of the insulative housing; wherein the latch member comprises a pair of base portions vertically extending from the top face and adjacent to the rear face of the insulative housing with predetermined heights for preventing extraneous materials from going between the actuator member and the deflectable portion thereof; wherein the deflectable portion of the latch member has a pair of cantilevered beams respectively extending from the base portions and substantially parallel to the top face of the insulative housing, a cross bar connecting the cantilevered beams with each other and a locking protrusion formed on an outer side of the cross bar for latching with the complementary connector; wherein the anti-overstress bar locates above the cantilevered beams and has a contact portion at a lower end thereof to press the cantilevered beams downward by applying a pressing force on the handle.

2. The electrical connector as claimed in claim 1, wherein the locking protrusion has a forward ramped surface and a rearward locking surface perpendicular to the top face of the insulative housing for locking with the complementary connector.

3. The electrical connector as claimed in claim 1, wherein the arced ribs are formed beside the cantilevered beams and each arced rib has a curved shape.

4. The electrical connector as claimed in claim 1, wherein the handle has a bottom face extending rearward and upward from the anti-overstress bar, a "V" shaped space being defined between the bottom face of the handle and the cantilevered beams.

5. An electrical connector assembly comprising:

a male connector having a dielectric body defining an aperture on a top wall thereof; and a female connector mated with the male connector, the female connector including:

an insulative housing defining a plurality of cavities for receiving a plurality of terminals therein and having a top face, a latch member formed on the top face and having a deflectable portion in a spaced relationship to the top face, the deflectable portion forming a locking protrusion locking with the aperture of the male connector, and an actuator member formed on the top face, the actuator member having a pair of arced ribs extending from the top face, an anti-overstress bar connected between the pair of arced ribs and located above the latch member for limiting deflection of the deflectable portion of the latch member relative to the top face of the insulative housing, and a handle extending from the anti-overstress bar for receiving an operation force to the actuator member; wherein the deflectable portion of the latch member further includes a pair of cantilevered beams respectively extending from the base portions and substantially parallel to the top face of the insulative housing, and a cross bar connecting the cantilevered beams with each other; wherein the anti-overstress bar locates above the cantilevered beams and has a contact portion at a lower end thereof to press the cantilevered beams downward by applying a pressing force on the handle.

6. The electrical connector as claimed in claim 5, wherein the plurality of cavities extend through opposite front and rear faces of the insulative housing.

7. The electrical connector assembly as claimed in claim 6, wherein the latch member comprises a pair of base portions vertically extending from the top face and adjacent to the rear face of the insulative housing with predetermined heights for preventing extraneous materials from going between the actuator member and the deflectable portion thereof.

8. The electrical connector assembly as claimed in claim 5, wherein the locking protrusion is formed on an outer side of the cross bar and has a forward ramped surface and a rearward locking surface vertical to the top face of the insulative housing for locking with the aperture of the male connector.

9. The electrical connector assembly as claimed in claim 5, wherein the arced ribs are formed beside the cantilevered beams and each has a curved shape.

10. The electrical connector assembly as claimed in claim 5, wherein the handle forms a top face having a shape like a terrace.

11. An electrical connector comprising:

an insulative housing defining a front-to-back direction and a mating port at a front end thereof;

a latch member extending around a rear portion of the insulative housing toward said front end, a forward locking protrusion located around a free end section of said latch member opposite to a fixed end thereof, a middle portion located between the fixed end and the locking protrusion; and an actuation member being discrete from said latch member and extending from the insulative housing and defining a pressing bar facing said middle portion opposite to said insulative housing; wherein said actuation member is deflectable toward the insulative housing to have the pressing bar press the middle portion toward the insulative housing and thus have the latch member deformed toward the insulative housing so as to move the locking protrusion toward the insulative housing in a direction generally perpendicular to said front-to-back direction; wherein said pressing bar prevents the latch member from being overstressed away from the insulative housing; wherein said actuation member includes a handle extending to the rear portion of the insulative housing.

12. The electrical connector as claimed in claim 11, wherein at least one of said latch member and said actuation member is integrally formed with the insulative housing.

* * * * *